US008793933B2

(12) United States Patent
Peterse et al.

(10) Patent No.: US 8,793,933 B2
(45) Date of Patent: Aug. 5, 2014

(54) SPRING BREAK PROTECTION MECHANISM FOR A SECTIONAL DOOR SYSTEM

(71) Applicant: Assa Abloy Entrance Systems AB, Landskrona (SE)

(72) Inventors: Antonius Johannes Peterse, Soest (NL); Jildert Adzer Gaastra, Zwolle (NL)

(73) Assignee: Assa Abloy Entrance Systems AB, Landskrona (SE)

( * ) Notice: Subject to any disclaimer, the term of this patent is extended or adjusted under 35 U.S.C. 154(b) by 0 days.

(21) Appl. No.: 13/898,760

(22) Filed: May 21, 2013

(65) Prior Publication Data

US 2013/0318879 A1 Dec. 5, 2013

(30) Foreign Application Priority Data

May 29, 2012 (EP) ..... 12169861

(51) Int. Cl.
*E05D 13/00* (2006.01)
*E06B 9/56* (2006.01)

(52) U.S. Cl.
USPC ..... 49/322; 160/291; 160/296

(58) Field of Classification Search
USPC ..... 49/322, 197, 199, 200; 187/365, 363, 187/367, 376; 188/82.34, 82.6, 82.7, 83; 160/201, 202, 8, 291, 296
See application file for complete search history.

(56) References Cited

U.S. PATENT DOCUMENTS 5,494,093 A * 2/1996 Eiterman ..... 160/300
6,862,845 B2 * 3/2005 Schiks ..... 49/322
7,254,868 B2 * 8/2007 Mullet et al. ..... 16/198
7,303,183 B2 * 12/2007 Winter ..... 254/378
7,428,918 B2 * 9/2008 Martin ..... 160/191
2002/0069585 A1 6/2002 Schiks
2003/0201077 A1 * 10/2003 Mullet et al. ..... 160/192
2003/0221801 A1 * 12/2003 Beaudoin et al. ..... 160/191
2006/0137138 A1 6/2006 Mullet et al.
2006/0169964 A1 * 8/2006 Winter ..... 254/376

FOREIGN PATENT DOCUMENTS

DE 3402343 A1 * 8/1985 ..... E05F 3/06
EP 0 151 427 A 8/1985
EP 0 495 499 7/1992

OTHER PUBLICATIONS

European search report issued for priority application EP 12169861.7 dated Nov. 2, 2012.

* cited by examiner

*Primary Examiner* — Jerry Redman
(74) *Attorney, Agent, or Firm* — Frommer Lawrence & Haug LLP; Ronald R. Santucci

(57) ABSTRACT

An assembly is provided comprising a spring break protection mechanism and a spring plug for connecting a balancing spring of a sectional door system to the spring break protection mechanism. The mechanism comprises a base plate with a circular opening for receiving a balancing axle. A ratchet wheel is rotatably arranged at a first side of said base plate to cooperate with the balancing axle. A pawl is pivotably connected to the base plate. Attached to said pawl is an extension extending from the pawl to beyond a second side of the base plate. The base plate and the spring plug are arranged for bayonet mount interaction wherein if the spring plug is placed against the second side of the base plate and then rotated for bayonet connection, part of the spring plug pushes the extension so as to force the pawl in the first position. If the spring plug is then rotated in an opposite direction, the pawl moves into the second position, to block the ratchet wheel so as to avoid rotation of the balancing axle.

10 Claims, 7 Drawing Sheets

SPRING BREAK PROTECTION MECHANISM FOR A SECTIONAL DOOR SYSTEM

TECHNICAL FIELD OF THE INVENTION

The present invention relates generally to a spring break mechanism for a sectional door system, and more particularly to an assembly of a spring break protection mechanism and a spring plug.

DESCRIPTION OF THE RELATED ART

In overhead doors torsion springs, generally 2 springs per door, are used to balance out the total weight of the door leaf, so the door can be opened with 'ease'. If the door is (partly) open and one of the springs breaks, the system gets out of balance, which will cause the door leaf to fall with force. This can lead to dangerous situations. In case of only one torsion spring, the danger is even higher.

To avoid these dangerous situations usually a torsion spring is connected to a so-called spring break device (SBD), i.e. a safety device that is arranged to stop the fall of the door leaf after the spring is broken. At the end of the torsion spring a plug is attached which is arranged to be connected to a base plate of the SBD. Installing the plugged spring to the SBD involves a lot of handling. A mechanic needs to remove nuts, usually two, from fixation points on the base plate using two wrenches. He will then have to position the plug on the fixation points, and next, place the two nuts on fixation points and tighten them using two wrenches at a time.

SUMMARY

It is an object of the present invention to provide a spring break mechanism which is easier to install.

According to a first aspect an assembly comprises a spring break protection mechanism and a spring plug for connecting a balancing spring of a sectional door system to the spring break protection mechanism, the spring break mechanism comprising:

- a base plate arranged for connection to the fixed world, and comprising a first substantially circular opening for receiving a balancing axle of the sectional door system;
- a ratchet wheel rotatably arranged at a first side of the base plate, the ratchet wheel being arranged to cooperate with the balancing axle;
- a pawl pivotably connected to the base plate at the first side, wherein the pawl is pivotable between a first position, in which the ratchet wheel is free-running, and a second position in which the pawl blocks the ratchet wheel;
- an extension attached to the pawl and extending from the pawl to beyond a second side of the base plate.

The base plate and the spring plug are arranged for bayonet mount interaction with each other, and wherein if the spring plug is placed against the second side of the base plate and then rotated for bayonet connection, part of the spring plug pushes the extension so as to force the pawl in the first position, and if the spring plug is then rotated in an opposite direction, the pawl moves into the second position, to block the ratchet wheel so as to avoid rotation of the balancing axle.

So while turning the plug to lock it, the plug will move the extension along, causing the pawl to move to its activated position. So by positioning the plug, a mechanic will also position the pawl. Furthermore, no tools are needed to connect the plug onto the base plate, which makes installing more easy and faster.

In an embodiment the base plate further comprises a first and second hook arranged at a second side of the base plate for bayonet mount interaction with spring plug.

In an embodiment the spring plug comprises a connection member for connecting the balancing spring, and a blade arranged at an outer end of the connection member and extending away from a central axis of the connection member into two opposing directions.

In an embodiment the blade is a substantially rhombic shaped comprising a central circular opening for receiving the balancing axle.

In an embodiment the base plate further comprises a second opening or an indentation, through which the extension is extending from the pawl to the second side of the base plate.

In an embodiment the pawl is biased by a biasing spring coupled between the pawl and the base plate.

In an embodiment the base plate is manufactured by punching at least four holes out of a metal sheet, the holes comprising a first disc shaped hole for receiving the axle, a second disc shaped hole for connection of a pivot of the pawl, a first substantially U-shaped hole for creating a first lip to form the first hook, and a second substantially U-shaped hole for creating a second lip to form the second hook.

In a further embodiment the extension is extending through an opening created by bending the first or second lip.

According to another aspect of the invention a spring break protection mechanism is provides for use in an assembly as described above.

According to yet another aspect of the invention, a sectional door system comprises:

- a door leaf composed of a number of door segments connected so as to be pivotable relative to a substantially horizontal pivot;
- a balancing axle;
- at least one balancing spring arranged around the balancing axle and coupled thereon at a first outer end of the spring;
- hoisting means coupled to the door leaf, which cooperates with the balancing spring for compensating the weight of the door segments suspended from the hoisting means,
- an assembly as described above, wherein the spring plug is arranged at a second outer end of the balancing spring.

DETAILED DESCRIPTION OF EMBODIMENTS

The present invention will now be described with reference to the figures, in which like reference labels are used to refer to like elements throughout the figures.

Figure 1:
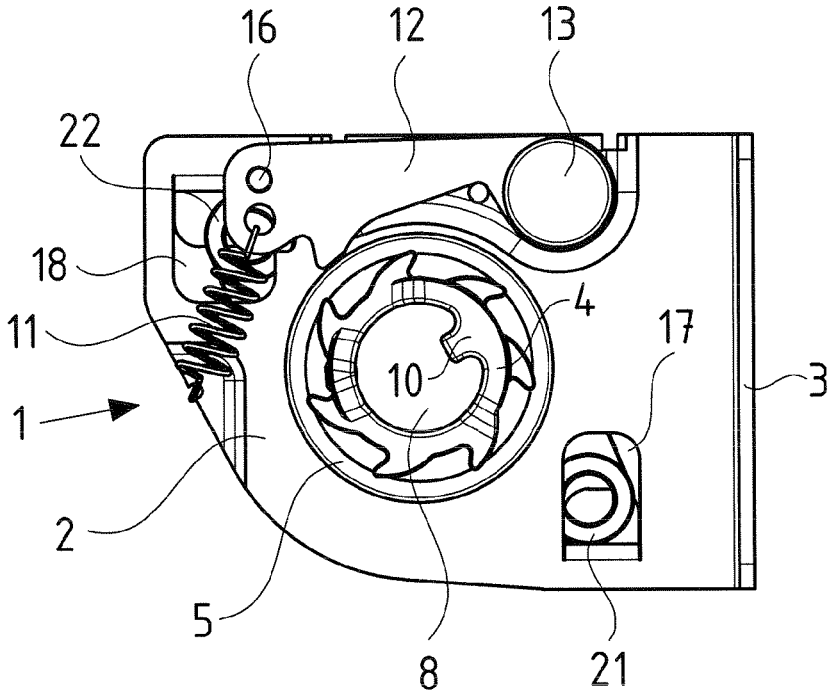
FIG. 1 shows a first side of the assembly with the pawl in an activated position according to an embodiment of the invention.

FIG. 1 is a first side of an assembly 1 according to an embodiment of the invention. The assembly 1 comprises a spring break protection mechanism comprising a base plate 2. The base plate 2 in this embodiment is bent into an L-profile, so as to form an arm 3 which is perpendicular to the plane of view. The base plate 2 comprises a first substantially circular opening in which a ratchet wheel 4 is rotatably arranged by means of a bearing 5. The ratchet wheel 4 is arranged at a first side of the base plate 2, viewed at in FIG. 1. The ratchet wheel 4 comprises a hole 8 for receiving a balancing axle (not shown) of a sectional door system (not shown). The ratchet wheel 4 is arranged to cooperate with the balancing axle, e.g. it can be coupled to a balancing axle having a coaxial groove which cooperated with a pin 10, see FIG. 1. The spring break protection mechanism further comprises a pawl 12 located at a first side of the base plate 2, and pivotably connected to the base plate 2, by means of a pivot 13, and biased by means of a spring 11. An extension 16 is attached to the pawl 12. The extension 16 in this embodiment is a pin 16 which extends from the pawl 12 to beyond a second side of the base plate 2, which will be discussed with reference to FIGS. 2 and 3. In the base plate 2, two more openings are present, see opening 17, 18 through which parts 21, 22 of a spring plug are visible in FIG. 1.

Figure 2:
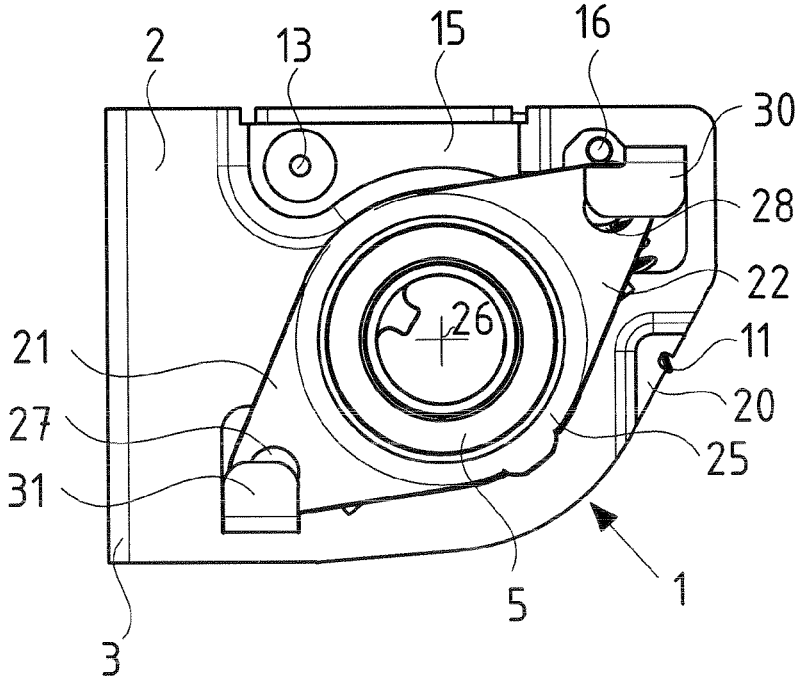
FIG. 2 shows a second side of the assembly of FIG. 1.

FIG. 2 shows the other side of the base plate 2, together with the spring plug. The spring plug comprises a connection member 25 for connection with a balancing spring (not shown), and a blade arranged at an outer end of the connection member and extending away from a central axis 26 of the connection member 25 into two opposing directions. In the embodiments of FIGS. 1 and 2, the blade has a substantially rhombic shape with two blade portions 21, 22. In this embodiment, in each the blade portions 21, 22 an opening 27, 28 is arranged. These openings 27, 28 do not have a particular function and can be left out. In state of the art spring plugs the openings 27, 28 are used for connecting by means of bolts and nuts.

The base plate 2 also comprises two hooks 30, 31. The hooks 30, 31 extend from the base plate 2 and have an L-shaped form. A housing of the bearing 5 is ring shaped and extends out of the main plane of the base plate 2 at the second side. When placed against the base plate 2, the plug will be positioned around the ring shaped bearing housing 5 and is rotatable around the housing 5. The plug can be rotated around its axis 26 until the blades 21, 22 meet the hooks 30, 31. In this way a bayonet like connection is achieved. In use the blades 21, 22 will be forced against the hooks 30, 31 by a torsion force of the biased balancing spring attached to the plug. The base plate 2 is pressed through to a certain extent, to manufacture two indented regions, see region 15 and 20. These regions 15, 20 are positioned out of the main plane of the base plate 12. In region 15 there is room for a head of the pivot 13. In region 20 there is room for the connection of the outer end of the spring 11.

Figure 3:
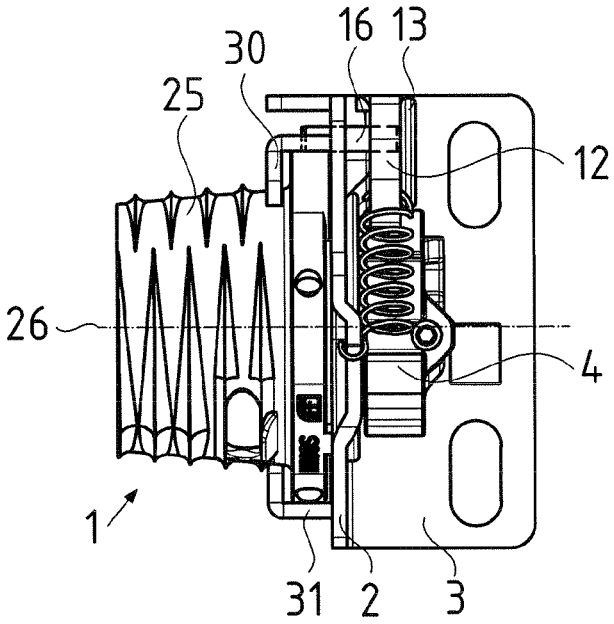
FIG. 3 shows a side view of the assembly of FIGS. 1 and 2.

FIG. 3 shows a side view of the assembly of FIGS. 1 and 2. As can be seen from FIG. 3 the connection member 25 of the plug comprises threaded grooves for interacting with an internal surface of a torsion spring (not shown). FIG. 3 also shows part of the pin 16 extending from the pawl 12, through the base plate 2. In FIGS. 1-3 the pawl 12 is in a first position in which the ratchet wheel 4 is free-running. The pawl 12 stays in the first position because the blade portion 22 forces the extension 16 (i.e. the pin) up, until the blade portion 22 meets the hook 30.

Figure 4:
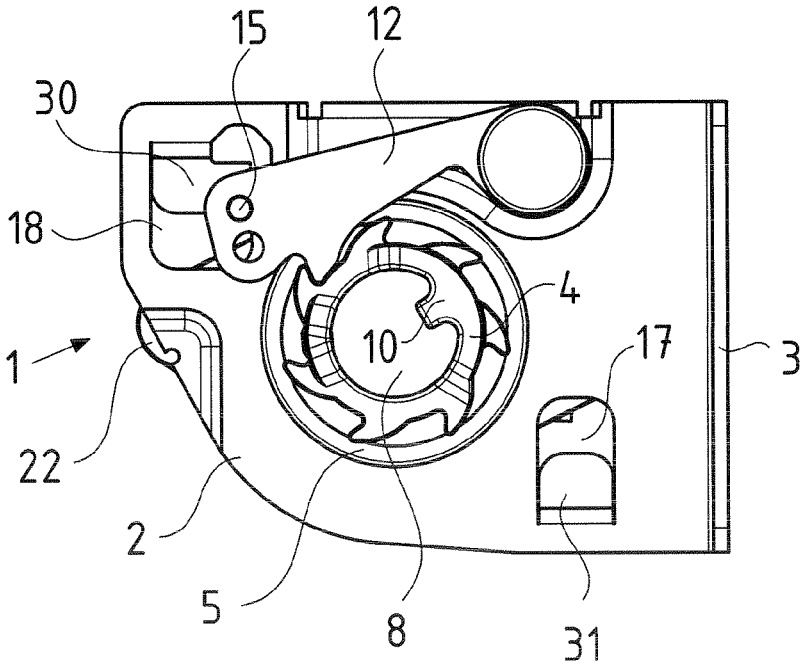
FIG. 4 shows the first side of assembly of FIG. 1 with the pawl in a blocked position.

FIG. 4 show the first side of the base plate 2 similar to FIG. 1. However, now the pawl 12 is in the second position in which the pawl 12 blocks the ratchet wheel 4. In FIG. 4 the plug is rotated relative to the position of FIG. 1. The blade 22 no longer forces the extension 16 up, and thus the pawl will fall to its blocked position due to the gravitational force.

Figure 5:
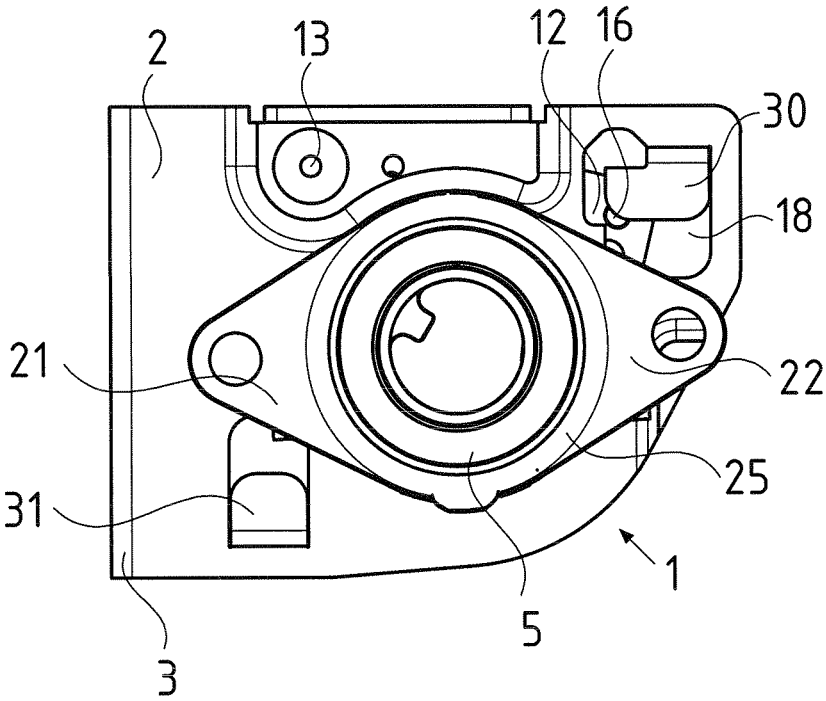
FIG. 5 shows the other side of the assembly of FIG. 4.
Figure 6:
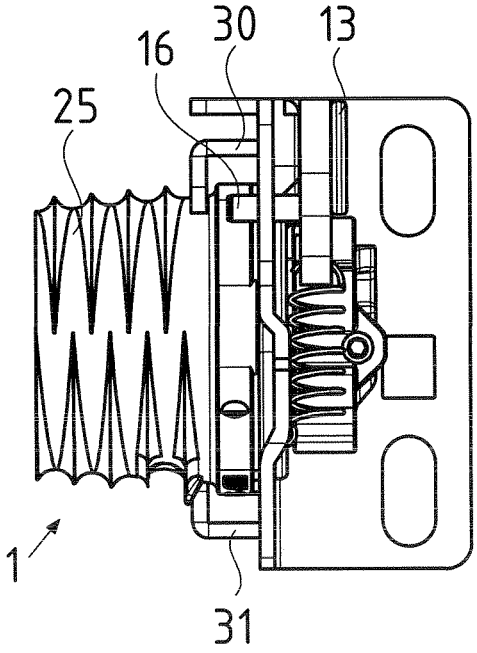
FIG. 6 is a side view of the assembly of FIGS. 4 and 5.

FIG. 5 shows the other side of the assembly wherein the pin 16 is visible. The pin 16 extends through the opening 18 of the base plate 2, so that it can make contact with the blade 22. FIG. 6 is a side view of the assembly similar to FIG. 3 but now the pawl 12 is in its blocked state as shown in FIG. 4.

As can be seen from FIGS. 4 and 5 the hook 30 and the opening 18 have a small indentation making space for the pin 16 when it is pushed up.

In this embodiment the pin 16 extends through the base plate at the opening 18. The opening 18 was created by bending the lip for forming the hook 30. So at the same time the hook 30 and an opening 18 for the pin are created. It should be noted that other solutions are possible and that the pin 16 may have a separately created opening with a form and dimension enabling the pin 16 to move into a circular trajectory. In an alternative, the pawl 12 extends beyond the borders of the base plate 2 wherein the pin 16 is located outside the base plate. In that case, there is no need for an opening or indentation for the pin 16 in the base plate 2. The pin 16 may be activated in that embodiment by a rotatable plug having blades, or other extensions, with a dimension so as to extend beyond the borders of the base plate 2.

Figure 7:
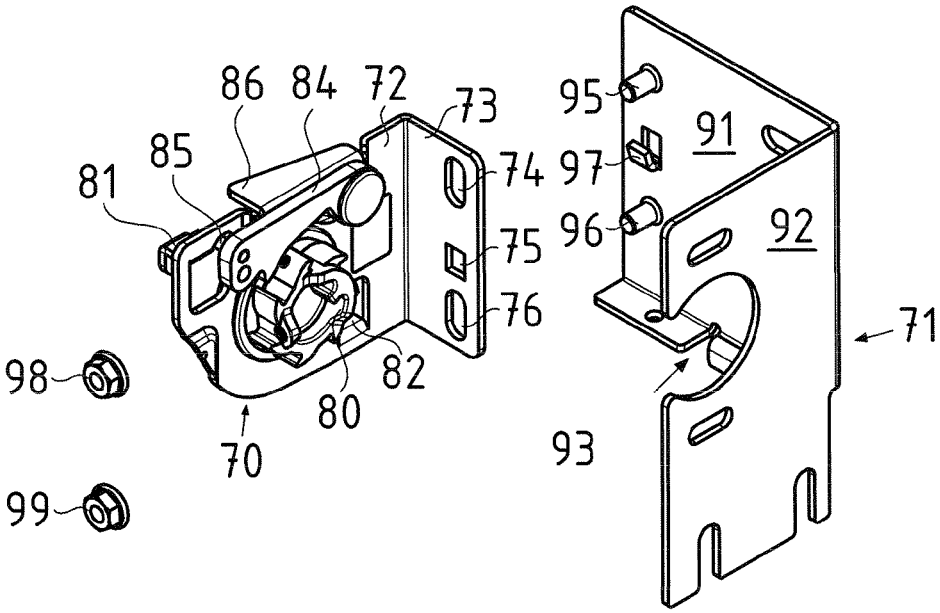
FIG. 7 is a perspective view of an embodiment of a spring break protection mechanism and a mounting plate for mounting a hoisting means.

FIG. 7 is a perspective view of an embodiment of a spring break protection mechanism 70 and a mounting plate 71 for mounting a hoisting means (not shown). The spring break protection mechanism 70 comprises a base plate 72 which is bent to create a mounting part 73 provided with three holes 74, 75, 76. The spring break protection mechanism 70 also comprises a ratchet wheel 80 rotatably arranged in the base plate 72. FIG. 7 also shows two hooks 81, 82 which are arranged to form a bayonet connection with a spring plug as was described above with reference to the embodiment of FIGS. 1-6. Pivotably connected to the base plate 72 is a pawl 84 having a pin 85 extending through the plate 72. Furthermore a guiding blade 86 is shown which is attached to the base plate 72. The mounting plate 71 comprises an L-profile formed by two parts 91, 92, the latter of which comprises an indentation 93 for receiving a balancing axle (not shown). Attached to the part 91 are two bolts 95, 96 and a hook 97. The bolts 95, 96 cooperate with two nuts 98, 99 shown to the left of FIG. 7.

Figure 8:
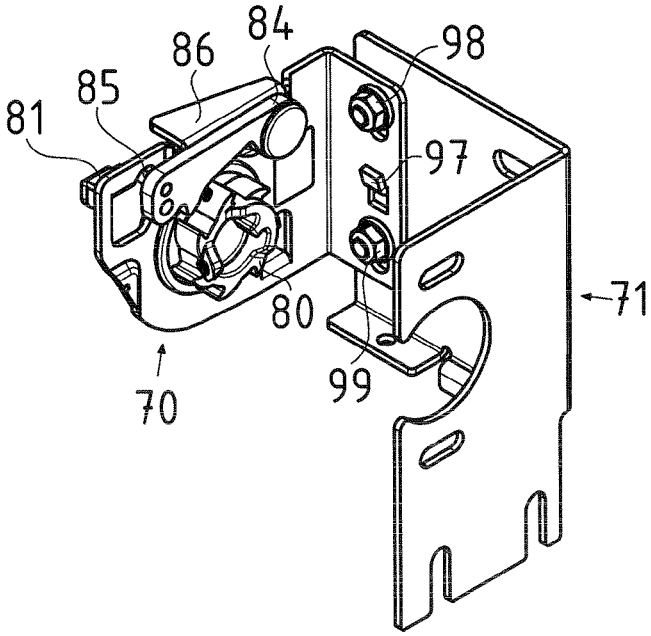
FIG. 8 shows a perspective of the spring break protection mechanism and the mounting plate of FIG. 7 in a mounted state.

FIG. 8 shows a perspective the spring break protection mechanism 70 and the mounting plate 71 in a mounted state. The base plate is hooked onto hook 97 and fastened to the mounting plate 71 by means of the bolts 95, 96 and nut 98, 99.

Figure 9:
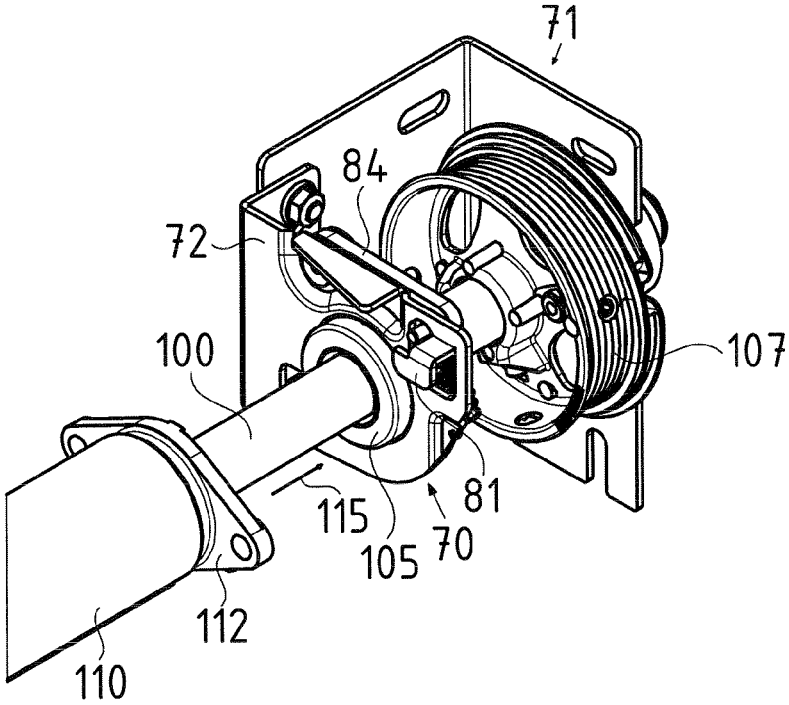
FIG. 9 shows the components of FIG. 8 together with a balancing axle.

FIG. 9 shows the components of FIG. 8 together with a balancing axle 100 which is placed through a bearing 105 of the spring break protection mechanism 70 and the indentation 93 of the mounting plate 71. A pulley 107 of a hoisting means is arranged around the axle 100. FIG. 9 also shows a balancing spring 110 and an attached plug 112 coaxially arranged around the axle 100.

Figure 10:
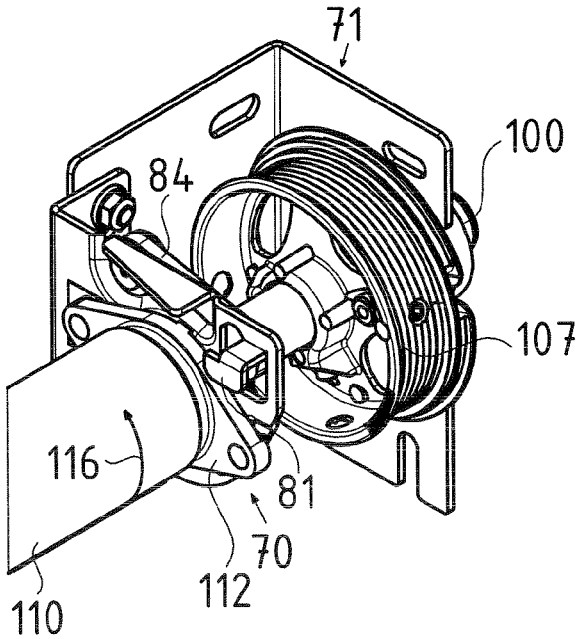
FIG. 10 shows the components of FIG. 9 with the plug contacting the base plate of the spring break mechanism.
Figure 11:
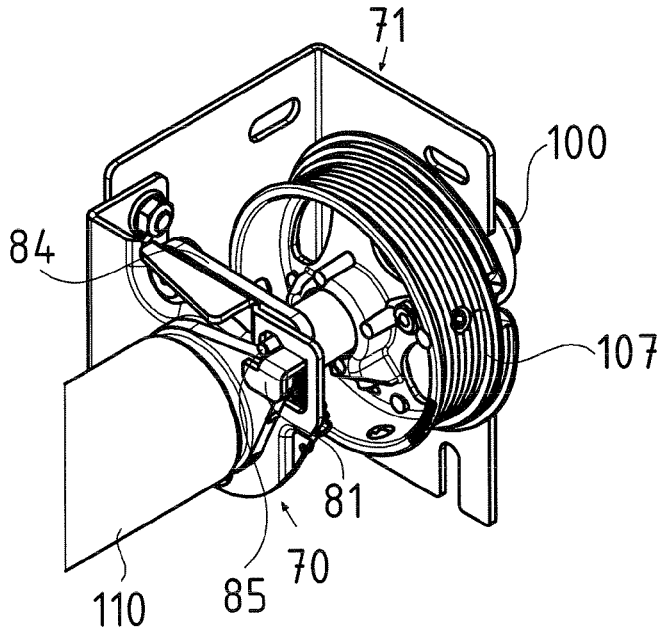
FIG. 11 shows the connected situation wherein the plug is mounted into 'bayonet catch', caught by the hooks.

To connect the balancing spring 110 to the spring break protection mechanism 70, a mechanic may perform the following actions. First the balancing spring 110 is fixed onto the axle 110 at a fixation point (not shown in FIG. 9) on the axle. Then the balancing spring 110 is biased by rotating the plug 112 or by rotating the axle 110. Next, the balancing spring is moved towards the spring break mechanism 70 while fixating the orientation of the plug 112, see arrows 115 in FIG. 9. Once the plug 112 contacts the base plate of the spring break mechanism 70, the plug 112 is released and, due to a torsion force of the balancing spring 110, the outer end of the balancing spring and the plug 112 will rotate, indicated by arrow 116 in FIG. 10. The plug 112 will rotate until its blades meet the hooks 81, 82 of the base plate 72. FIG. 11 shows the connected situation wherein the plug 112 is mounted into 'bayonet catch', caught by the hooks 81, 82. When the plug 112 is in bayonet catch, one of the blades of the plug 112 pushes the pin 85 upwards so as to position the pawl 84 in its first position wherein the ratchet wheel 80 is free running. So while turning the plug 112 to lock it, the plug 112 will move the pin 85 along, causing the pawl 84 to move to its activated position. So positioning the plug 122 will position the pawl 84.

The above described mounting procedure is easy to perform. Elimination of the bolt and nut-fixation points used in present mechanisms makes the spring break mechanism easy to install which saves time for the mechanic Furthermore, leaving out the bolts and nuts will make the spring break mechanism cheaper than the current devices.

In the above described embodiments, the plug comprises a connection member 25 for connecting the balancing spring, and a substantially rhombic shaped blade arranged at the outer end of the connection member 25. The blade extends away from the central axis 26 of the connection member 25 into two opposing directions, see FIG. 2. It should be noted that other 'bayonet catch' mount configurations are possible. Instead of a blade the plug may have two arms extending in opposite directions. The arms may for example cooperate with hooks arranged on the base plate of the spring break mechanism. Alternatively, the hooks may be arranged onto the blade of the plug, cooperating with holes in the base plate of the spring break mechanism.

Figure 12:
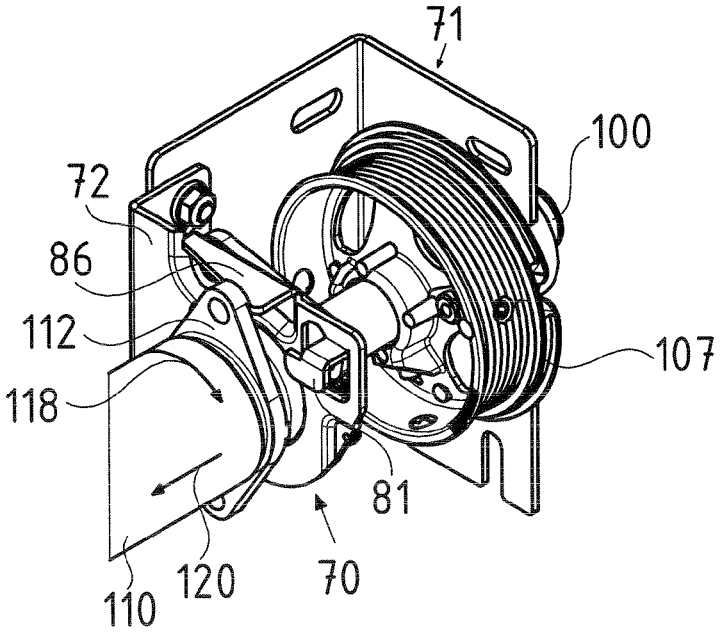
FIG. 12 shows the disconnected situation wherein the plug is released out of the 'bayonet catch'.

In case of a spring break the torsion force which forces the plug 112 into its fixed position, see FIG. 11, suddenly disappears. In that event, the plug 112 is automatically rotated as is indicated in FIG. 12, see arrow 118. If the blade of the plug 112 meets the guiding blade 86, it is forced away from the base plate 72. This is due to the gradually increasing dimension of the guiding blade 86 in the direction of rotation 118. As a result, the plug 112 will, while rotating, be disconnected from the base plate 72. Due to the guiding blade 86, the blade of the plug 112 will be force away from the base plate 73, see arrow 120, and collision with the hook 81 is avoided.

As soon as the plug 112 start rotating, the pawl 84 will fall into its blocking position, as was discussed with reference to FIGS. 4-6. The pawl 84 will block the ratchet wheel 80 so as to avoid the axle 100 from turning.

In an embodiment, the pawl 12; 84 is biased by a biasing spring 11 coupled between the pawl 12; 84 and the base plate 2; 72. The biasing spring 11, see e.g. FIG. 1, will increase the speed of the pawl 12; 84 and thus decrease the time it needs to block the ratchet wheel 4; 80, avoiding high forces on the spring break mechanism.

Figure 13:
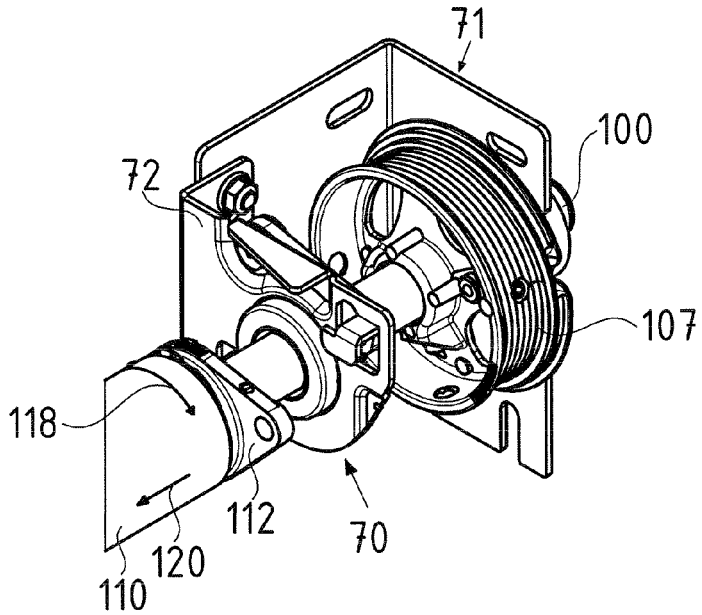
FIG. 13 shows the components of FIG. 12 wherein a broken balancing spring and the plug move further away from the base plate.

FIG. 13 shows the components of FIG. 12 wherein the broken balancing spring 110 and the plug 112 move further away from the base plate 72. Once all the forces in the balancing spring are released, the balancing spring 110 will come to a rest.

Figure 14:
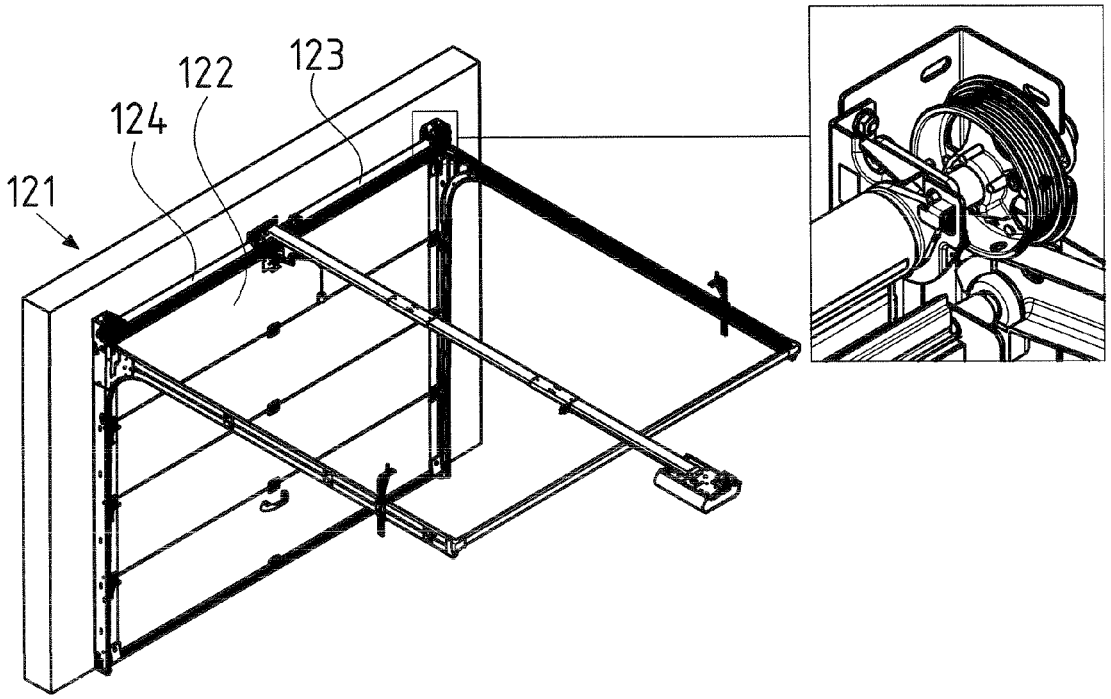
FIG. 14 shows a sectional door system according to an aspect of the invention.

FIG. 14 shows a sectional door system 121 according to an aspect of the invention. The system 121 comprises a door leaf 122 composed of a number of door segments connected so as to be pivotable relative to a substantially horizontal pivot. A balancing axle (not visible in FIG. 14) is horizontally arranged between to opposing sides of the system. Two balancing springs 123, 124 are arranged around the balancing axle and coupled thereon at a first outer end of the springs. Hoisting means are coupled to the door leaf 122, which cooperates with the balancing springs for compensating the weight of the door segments suspended from the hoisting means. The system 121 comprises two assemblies (one of them is shown in an exploded view of FIG. 14) as described above wherein the spring plugs are arranged at a second outer end of the balancing springs.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

What is claimed is:

1. An assembly comprising a spring break protection mechanism and a spring plug for connecting a balancing spring of a sectional door system to said spring break protection mechanism, said spring break mechanism comprising:

a base plate having a first substantially circular opening for receiving a balancing axle of said sectional door system;

a ratchet wheel rotatably arranged at a first side of said base plate, said ratchet wheel being arranged to cooperate with said balancing axle;

a pawl pivotably connected to said base plate at said first side, wherein the pawl is pivotable between a first position, in which the ratchet wheel is free-running, and a second position in which the pawl blocks the ratchet wheel;

an extension attached to said pawl and extending from said pawl to beyond a second side of said base plate, wherein said base plate and said spring plug are arranged for bayonet mount interaction with each other, and wherein when said spring plug is placed against said second side of said base plate and then rotated for bayonet connection, part of said spring plug pushes said extension so as to force said pawl in said first position, and when said spring plug is then rotated in an opposite direction, said pawl moves into said second position, to block the ratchet wheel so as to avoid rotation of the balancing axle.

2. An assembly according to claim 1, wherein said base plate further comprises a first and second hook arranged at a second side of said base plate for the bayonet mount interaction with said spring plug.

3. An assembly according to claim 1, wherein said spring plug comprises a connection member for connecting said balancing spring, and a blade arranged at an outer end of said connection member and extending away from a central axis of said connection member into two opposing directions.

4. An assembly according to claim 3, wherein said blade is a substantially rhombic shaped comprising a central circular opening for receiving said balancing axle.

5. An assembly according to claim 1, wherein said base plate further comprises a second opening or an indentation, through which said extension is extending from said pawl to said second side of said base plate.

6. An assembly according to claim 1, wherein said pawl is biased by a biasing spring coupled between said pawl and said base plate.

7. An assembly according to claim 1, wherein said base plate is manufactured by punching at least four holes out of a metal sheet, said holes comprising:

a first disc shaped hole for receiving said axle;

a second disc shaped hole for connection of a pivot of said pawl;

a first substantially U-shaped hole for creating a first lip to form said first hook;

a second substantially U-shaped hole for creating a second lip to form said second hook.

8. An assembly according to claim 7, wherein said extension is extending through an opening created by bending said first or second lip.

9. A spring break protection mechanism for use in an assembly comprising a spring plug for connecting a balancing spring of a sectional door system to said spring break protection mechanism, said spring break mechanism comprising:

a base plate having a first substantially circular opening for receiving a balancing axle of said sectional door system;

a ratchet wheel rotatably arranged at a first side of said base plate, said ratchet wheel being arranged to cooperate with said balancing axle;

a pawl pivotably connected to said base plate at said first side, wherein the pawl is pivotable between a first position, in which the ratchet wheel is free-running, and a second position in which the pawl blocks the ratchet wheel;

an extension attached to said pawl and extending from said pawl to beyond a second side of said base plate, wherein said base plate and said spring plug are arranged for bayonet mount interaction with each other, and wherein when said spring plug is placed against said second side of said base plate and then rotated for bayonet connection, part of said spring plug pushes said extension so as to force said pawl in said first position, and when said spring plug is then rotated in an opposite direction, said pawl moves into said second position, to block the ratchet wheel so as to avoid rotation of the balancing axle.

10. A sectional door system comprising:

a door leaf composed of a number of door segments connected so as to be pivotable relative to a substantially horizontal pivot;

a balancing axle;

at least one balancing spring arranged around said balancing axle and coupled thereon at a first outer end of said spring;

hoisting means coupled to the door leaf, which cooperates with said balancing spring for compensating the weight of the door segments suspended from the hoisting means, an assembly comprising a spring break protection mechanism and a spring plug for connecting said balancing spring of said sectional door system to said spring break protection mechanism, said spring break mechanism comprising:

a base plate having a first substantially circular opening for receiving said balancing axle of said sectional door system;

a ratchet wheel rotatably arranged at a first side of said base plate, said ratchet wheel being arranged to cooperate with said balancing axle;

a pawl pivotably connected to said base plate at said first side, wherein the pawl is pivotable between a first position, in which the ratchet wheel is free-running, and a second position in which the pawl blocks the ratchet wheel;

an extension attached to said pawl and extending from said pawl to beyond a second side of said base plate, wherein said base plate and said spring plug are arranged for bayonet mount interaction with each other, and wherein when said spring plug is placed against said second side of said base plate and then rotated for bayonet connection, part of said spring plug pushes said extension so as to force said pawl in said first position, and when said spring plug is then rotated in an opposite direction, said pawl moves into said second position, to block the ratchet wheel so as to avoid rotation of the balancing axle;

wherein said spring plug is arranged at a second outer end of said balancing spring.

* * * * *